United States Patent [19]

Sloate

[11] Patent Number: 4,762,147

[45] Date of Patent: Aug. 9, 1988

[54] SERVO VALVE WITH TORQUE FEEDBACK

[76] Inventor: Harry M. Sloate, 7 Milldam Rd., Acton, Mass. 01720

[21] Appl. No.: 65,411

[22] Filed: Jun. 22, 1987

Related U.S. Application Data

[63] Continuation-in-part of Ser. No. 831,976, Feb. 20, 1986, Pat. No. 4,674,537.

[51] Int. Cl.[4] ..... F15B 13/043

[52] U.S. Cl. ..... 137/625.64; 137/625.6

[58] Field of Search ..... 137/625.6, 625.63, 625.64

[56] References Cited

U.S. PATENT DOCUMENTS

| | | | |
|---|---|---|---|
| Re. 25,338 | 2/1963 | Olson | 251/30 |
| 123,174 | 1/1872 | Hopkins | 137/625.63 |
| 1,005,641 | 10/1911 | Gilson | 251/25 |
| 2,600,348 | 6/1952 | Walthers | 137/623 |
| 2,615,466 | 10/1952 | Garde | 137/623 |
| 2,621,676 | 12/1952 | Loft | 137/622 |
| 3,023,782 | 3/1962 | Chaves, Jr. et al. | 137/622 |
| 3,033,228 | 5/1962 | Mohler | 137/490 |
| 3,106,224 | 10/1963 | Moss | 137/625.63 |
| 3,125,002 | 3/1964 | McCombs | 91/365 |
| 3,174,406 | 3/1965 | Hague et al. | 91/19 |
| 3,219,060 | 11/1965 | Pearl et al. | 137/625.6 |
| 3,311,123 | 3/1967 | Tsien et al. | 137/625.64 X |
| 3,386,457 | 6/1968 | Adams | 137/85 |
| 3,405,600 | 10/1968 | Ballard et al. | 90/21.5 |
| 3,420,141 | 1/1969 | Hague et al. | 90/14 |
| 3,424,183 | 1/1969 | Coakley | 137/625.64 X |
| 3,523,673 | 8/1970 | Mitchell et al. | 251/24 |
| 3,566,919 | 3/1971 | Vanderlaan | 137/625.63 |
| 3,568,718 | 3/1971 | Wilke | 137/625.6 |
| 3,665,807 | 5/1972 | Bartholomaus et al. | 91/378 X |
| 3,674,041 | 7/1972 | Beals | 137/1 |
| 3,696,835 | 10/1972 | Pauliukonis | 137/625.6 |
| 4,145,956 | 3/1979 | Rumrill et al. | 137/625.64 X |
| 4,243,062 | 1/1981 | Shelton | 137/62 |
| 4,281,676 | 8/1981 | Morris | 137/102 |
| 4,368,750 | 1/1983 | Burton | 137/85 |
| 4,371,178 | 2/1983 | Ott | 277/154 |
| 4,545,409 | 10/1985 | Luhmer | 137/625.64 |

OTHER PUBLICATIONS

Jet-Pipe Servovalves, a Design for Reliability brochure.

Olsen Controls, Inc. Model LS-300 Linear Electro-Hydraulic Pulse Drive Specifications.

Advertisement for Double A's Solenoid Valves.

Picture of a MOOG Inc. Servovalve.

Copy of a Photograph of an Air Directional Spool Valve With a Solenoid Controlled Pilot Stage.

*Primary Examiner*—Gerald A. Michalsky

*Attorney, Agent, or Firm*—Willian Brinks Olds Hofer Gilson & Lione Ltd.

[57] ABSTRACT

A servo valve assembly having torque feedback includes a housing and a valve spool disposed for axial translation therein. The valve spool has a plurality of lands alternating with three reduced diameter regions which cooperate with axially spaced apart inlet, return and service ports in the housing. The servo mechanism includes a piston integrally formed with the valve spool. An axial bore extends through the spool and receives a control rod having an axially extending flat which cooperates with radial passageways in the valve spool. At the end of the control rod is a torque motor which rotates bi-directionally and provides an input signal to which the servo valve assembly responds. Between the torque motor and the valve housing is a torque feedback assembly. The assembly includes a pair of cantilever spring arms each fixed at one end, the opposite ends of each of the cantilever arms coupled to a respective pair of pistons which are in communication with respective service ports. A cross member interconnects the cantilever arms adjacent the pistons. A pair of springs couple the cantilever arms to a torque arm extending radially from the control rod. In an alternate embodiment, torque feedback is provided directly from the valve spool to one of the cantilever spring arms through a pivoted, right angle crank arm.

21 Claims, 2 Drawing Sheets

SERVO VALVE WITH TORQUE FEEDBACK

CROSS REFERENCE TO CO-PENDING APPLICATION

This application is a continuation-in-part application of Ser. No. 831,976 filed Feb. 20, 1986, now U.S. Pat. No. 4,674,539, granted June 23, 1987.

BACKGROUND OF THE INVENTION

This invention relates to pilot controlled spool valves and, in its presently preferred embodiments, to new and improved servo controlled pilot stages and spool valves.

Spool-type valves are typically used to control the flow of pressurized fluid, such as hydraulic oil, water or air to a hydraulic cylinder or similar device. The size and diameter of the spool determine the flow capacity of the valve and thus the rate of energy transfer through the valve. The position of the spool within its valve body controls the amount and direction of fluid flow through the valve. Because the fluid flow forces and spool mass are typically high, pilot stages can be used to control the spool position which in turn controls the fluid flow.

There are generally three types of spool-type valves: directional control, proportional control, and servo or feedback control. Directional control valves are used to commence and interrupt fluid flow. These valves are used in the majority of fluid control applications. Proportional control pilot valves control the amount of fluid flow in proportion to an input signal. The use of these valves in applications is increasing. Servo-type pilot valves use mechanical feedback from the spool to a pilot stage to control spool position. These valves are used in high performance, proportional control applications where accurate closed loop control is essential.

One conventional type of directional spool valve uses a solenoid to control spool position. A first solenoid is attached to one end of the valve housing and the solenoid plunger is coupled to one end of the valve spool. A second solenoid is attached to the opposite end of the valve housing and the plunger of the second solenoid is coupled to the opposite end of the valve spool. The solenoids are alternately energized to move the spool and start and stop the fluid flow. Specifically, when the first solenoid is energized, it translates its plunger and drives the spool in one direction to turn on fluid flow in one direction. When the second solenoid is energized, its plunger drives the spool in the opposite direction to turn on fluid flow in the other direction.

This type of conventional directional valve has several drawbacks. The two solenoids and their associated electrical connections add bulk, weight, and significant power consumption to the valve package. The plungers are fabricated from iron and are relatively heavy and thus require significant electrical energy to be translated by the solenoid coils. Twenty-four volts and one ampere are typical electrical requirements of such solenoids which thus consume twenty-four watts of power. Of greater concern in systems is the slow response of such solenoids which is generally about 100 milliseconds.

One type of conventional proportional valve also uses a solenoid to control spool position. In this valve, however, a solenoid and its plunger are attached to only one end of the spool. A spring is attached to the other end of the spool. When the solenoid is energized, it translates the plunger which pushes the spool against the bias of the spring. The force of the spring provides proportional control of the flow of fluid. When the solenoid is de-energized, the spring returns the spool to the off position.

This type of proportional valve also shares the drawbacks of the solenoid controlled directional control valve. Specifically, high electrical current, and thus power, is necessary to move the spool against the spring. Moreover, this design is not well suited for high pressure applications.

A widely used servo-type valve is disclosed in U.S. Pat. No. 3,023,782 (Chaves). This valve uses a torque motor pilot stage with negative feedback provided by a flapper 73 in mechanical contact with the spool. The pilot stage shifts the spool, which can be subject to large fluid forces, in response to a small electrical signal to the torque motor. The position of the flapper is negatively fed back to the pilot stage to control the spool position. This negative feedback provides linearity and minimizes hysteresis.

While the Chaves servo valve provides some advantages, it also has significant disadvantages. These valves are complex and expensive to manufacture. The current price for a 10 gallon per minute valve is around $1000.00. Furthermore, these valves are susceptible to clogging due to the small orifices (on the order of 0.005 inch) in the pilot stage. Thus, extensive filtering of hydraulic fluid, is necessary to avoid contamination problems.

Another servo operated spool valve is disclosed in U.S. Pat. No. 3,106,224 (Moss). This patent discloses a spool 1 and a cylindrical spindle 13, which extends through an axial bore in the spool and the two ends of the valve housing 7. Two helical grooves 15 and 16 are formed in the surface of the spindle and are spaced from each other by approximately one-half helical pitch, so that each groove extends from one end of the valve housing cavity past a pair of diametrically opposed radial bores 17 in the spool. In its central position, the radial bores should be inside the central port 3 of the valve housing, and each groove should uncover equal parts of one of the radial bores.

The spool is maintained in its central position by a continuous flow of oil through the valve housing and spool that provides equal fluid pressure at both ends of the housing bore. In particular, the oil flows along two branches from the pressure inlet 24, through ports 2 and 4, passages 20 and 22, and orifices 21 and 23, to the two end chambers of the bore in housing 7, through the grooves 15 and 16 and the radial bores 17 to the drain port 12. In this central, null position, lands 5 and 6 block the flow of oil through the service ports 10 and 11.

In order to move the spool axially, the spindle 13 is rotated. This will cause one groove to uncover a greater portion of one radial bore and the other groove to cover a greater portion of the opposite radial bore. As a result, the fluid pressure in one end chamber of the valve housing will be greater than the other, and the spool will move towards the chamber of lower pressure until the fluid pressure in each chamber is equal. At this point, each radial bore will be uncovered the same amount again. The axial movement of the spool is proportional to the rotary displacement of the spindle 13.

The Moss servo valve is less complex and more desirable than the Chaves servo valve. However, the Moss servo valve also has some significant drawbacks. The Moss valve is designed to have continuous oil flow, even at null, between both ends of the valve housing to balance the pressure across the spool. This continuous flow requirement consumes power even at null. The design complicates the manufacture of the valve. The spindle grooves 15 and 16 and radial bores 17 must be designed in a relationship that facilitates constant flow. The passages 20 and 22 and orifices 21 and 23 must be machined into the outer lands 18 and 21 of the spool. The orifices 21 and 23 must be the same size so that each end chamber has about one-half of the fluid pressure at the null position. The orifices and radial holes should also be small to minimize flow at null. The small holes, however, are more prone to contamination.

SUMMARY OF THE INVENTION

The present invention is directed to an improved pilot control for valves utilizing a servo mechanism. In many respects, the invention and following disclosure are similar to and incorporate portions of my U.S. Pat. No. 4,683,915, issued Aug. 4, 1987, and directed to Pilot Controlled Valves which is hereby incorporated by reference as well as my co-pending patent application Ser. No. 831,976, filed Feb. 20, 1986, directed to a Rotary Servo Valve, now U.S. Pat. No. 4,674,539, granted June 23, 1987.

A servo valve according to the present invention includes a torque feedback assembly. A housing defines a through bore which receives a substantially conventional valve spool. The valve spool is disposed for axial translation within the bore and defines a plurality of alternating lands and reduced diameter regions which cooperate with axially spaced apart inlet, return and service ports in the housing.

The servo mechanism includes a piston integrally secured to the valve spool which is received within a cylinder. The piston is double acting and one face of the piston and adjacent chamber communicate with the inlet port of the servo valve assembly. An axial bore extends through the valve spool and receives a control rod having an axially extending flat. The flat defines a chordal surface and cooperates with two radial passageways in the valve spool. The axial flat provides selective communication between the two radial passageways and the other face of the piston and adjacent chamber.

The control rod is acted upon, that is, rotated by two mechanisms. At the outer end of the control rod is a torque motor which rotates clockwise or counterclockwise and provides a mechanical input signal to the servo valve assembly which it acts upon. Between the torque motor and the servo valve housing is a torque feedback assembly. The assembly includes a pair of cantilever spring arms each fixed at one of their respective ends. The opposite ends of the cantilever spring arms are coupled to a respective pair of pistons. The pistons are slidably disposed in cylinders which are in fluid communication with respective service ports. A cross member couples the cantilever spring arms adjacent the pistons such that they translate substantially in unison. A pair of springs couple the cantilever spring arms to a torque arm extending radially from the control rod.

In an alternate embodiment, a right angle crank arm which couples the motion of the valve spool to one of the cantilever spring arms provides direct motional feedback which is then converted to torque feedback.

It is thus an object of the present invention to provide a servo valve assembly having torque feedback.

It is a still further object of the present invention to provide a servo valve assembly having a pair of pistons which communicate with the outlet or service ports of the servo valve and provide torque feedback to the input of the servo valve.

It is a still further object of the instant invention to provide a servo valve wherein motional feedback is provided directly from the valve spool to a cantilever spring arm which is coupled to the servo valve control input.

It is a still further object of the instant invention to provide a servo valve having torque feedback which includes a pair of cantilever spring arms coupled to the servo valve input control rod through a pair of resilient, tensioning members.

Further objects and advantages of the present invention will become apparent by reference to the following description of the preferred and alternate embodiments and the appended drawings.

DESCRIPTION OF THE PREFERRED EMBODIMENT

Figure 1:
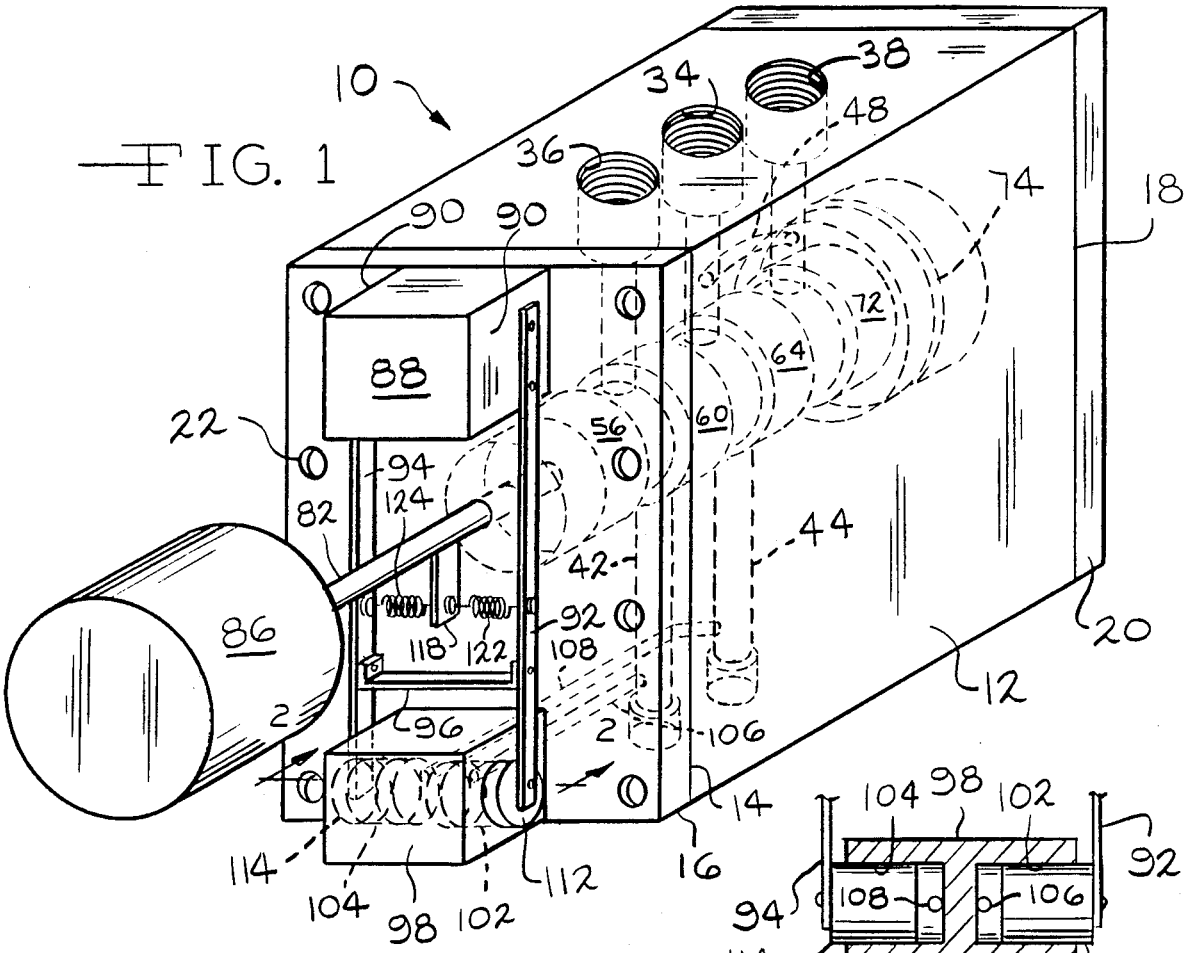
FIG. 1 is a perspective view of a preferred embodiment of a servo valve with torque feedback according to the present invention.

The present invention will now be described with reference to the two embodiments illustrated in the attached drawings. These drawings depict a preferred embodiment and an alternate embodiment. It should be understood that the present invention is not limited to the embodiments illustrated in the drawings and described below. Rather, the invention is intended to apply to control valves generally, especially spool-type valves, and the embodiments shown and described herein are exemplary and illustrative only. It will be apparent to those skilled in the art that the present invention can be adapted to many variations in addition to those described herein.

With regard first to the preferred embodiment illustrated in FIGS. 1, 2, 3 and 4, a servo valve assembly according to the present invention is illustrated and generally designated by the reference numeral 10. The servo valve assembly 10 includes a generally elongate rectangular housing 12 having a first end 14 which is closed by a first end plate 16 and a second end 18 which is closed by a second end plate 20. The first and second end plates, 16 and 20, respectively, are secured to the housing 12 by pluralities of fasteners such as machine screws 22 which extend through openings 24 in the end plates 16 and 20 and are received within suitably sized and threaded blind openings 26. A bore 28 extends longitudinally through the rectangular housing 12 from the first end 14 to the second end 18. The bore 28 defines a smaller diameter region 30 extending along a greater axial portion of its length and a larger diameter cylinder 32 extending along a lesser axial portion of its length.

A plurality of radially extending passageways or ports communicate with the smaller diameter region 30 of the bore 28. Specifically, there is a centrally disposed threaded pressure inlet port 34 (P), a first threaded pressure return port 36 (T1), a second threaded pressure return port 38 (T2), a first service port 42 (A), and a second service port 44 (B). In accordance with conventional practice, the service ports 42 and 44 are connected to a fluid or hydraulic device (not illustrated) which the servo valve assembly 10 is controlling. The relative circumferential positions of the ports 34, 36, 38, 42 and 44 about the bore 28 are without significance. Thus, while in FIG. 1, the ports 34, 36, 38, 42 and 44 have been arranged in planar alignment, this has been done primarily for purposes of illustration, clarity and simplicity. Diverse circumferential arrangements of the ports 34, 36, 38, 42, and 44 are anticipated and within the purview of the patent invention. The housing 12 also includes an inlet passageway 48 communicating between the pressure inlet port 34 and the end of the larger diameter cylinder 32 of the bore 28 adjacent the smaller diameter region 30. As best illustrated in FIG. 1, the passageway 48 is adjacent but offset from the second pressure return port 38.

Axially slidably disposed within the bore 28 is a valve spool 50. The valve spool 50 defines a plurality of alternating lands and reduced diameter portions disposed within the smaller diameter region 30 of the bore 28, and a larger diameter piston 74 or control land disposed within the larger diameter cylinder 32 of the bore 28. The angular position of the valve spool 50, that is, its position about its longitudinal axis is adjustable in order to trim its axial null position to, for example, match associated components in a given installation. A set screw 52 extending through and rotatably secured within the second end plate 20 and offset from the axis of the valve spool 50 includes an eccentrically mounted stub which engages a radially extending slot 54 in the piston 74. Rotation of the set screw 52 causes limited rotation of the valve spool 50 about its axis as will be readily appreciated.

There is a first land 56 which generally defines the end of the valve spool 50 most proximate the first end plate 16. Axially spaced from the first land 56 by a first reduced diameter region 58 is a second land 60. The second land 60 has a width measured along the longitudinal axis of the valve spool 50 equal to the width of the first service port 42 at its junction with the bore 28. A second reduced diameter region 62 separates the second land 60 from a third land 64. The third land 64 has an axial width equal to the width of the second service port 44 at its junction with the bore 28 and is spaced from the second land 60 such that they both seal off the respective service ports at a given position of the valve spool 50, such position being best illustrated in FIG. 3.

Positioned axially between the second land 60 and third land 64 in the second reduced diameter region 62 is a first radially oriented bore 66 which extends inwardly from the surface of the second reduced diameter region 62. Adjacent the third land 64 is a third reduced diameter region 68. A second radially oriented bore 70 extends inwardly from the surface of the third reduced diameter region 68. The bores 66 and 70 are oriented 180° apart, that is, their center lines lie in a common plane but they extend along diametrically opposite, axially spaced apart radii. Finally, the valve spool 50 includes a fourth land 72 which extends from the third reduced diameter region 68 to a piston 74 which engages the walls of the cylinder 32.

The lands 56, 60, 64, and 72 and the piston 74 are machined to provide approximately 1/1000 of an inch clearance between them and the surface of the bore 28. If desired, the piston 74 may be provided with a O-ring type seal (not illustrated) about its periphery. It should also be noted that the lands 56, 60, 64 and 72 can be provided with circumferential centering grooves to counteract pressure imbalances as is well known in the art.

The piston 74 divides the larger diameter cylinder 32 of the bore 28 and defines a first chamber 76 and a second chamber 78. The effective area of the piston 74, that is, that surface area exposed to fluid pressure in the first chamber 76 is preferably one-half the effective area of the piston 74 in the second chamber 78. The inlet passageway 48 opens into the first chamber 76, and thus provides communication between the pressure inlet port 34 and the first chamber 76, as noted above.

The valve spool 50 defines a co-axial passageway or bore 80 which extends from one end of the valve spool 50 to the other. The bore 80 intersects the first radial bore 66 and the second radial bore 70. Slidably and rotatably received within the bore 80 is a control rod 82. The control rod 82 has an axially extending chordal portion removed and thus defines an axially extending chordal surface or flat 84. The flat 84 extends from the end of the control rod 82 generally adjacent the fourth land 72 to a distance beyond the first radial bore 66 and provides selective fluid communication between the bores 66 and 70 and the second chamber 78. If desired, an opposed arrangement of right angle channels may be utilized to provide pressure balancing of the control rod 82, thereby minimizing the magnitude of forces required to move it, as set forth in FIG. 4 and the accompanying text of my U.S. Pat. No. 4,674,539. The end of the control rod 82 is coupled to an input control motor, such as a torque motor 86.

A mounting block 88, which may be secured to or formed as an integral part of the first end plate 16, defines two parallel spaced apart surfaces 90 to which are secured a first, cantilever spring arm 92 and a second, parallel cantilever spring arm 94. The cantilever spring arms 92 and 94 are preferably fabricated of flat spring steel stock or comparable material. Near the ends of the cantilever spring arms 92 and 94 opposite the mounting block 88 is a rigid link 96 which couples the first cantilever spring arm 92 to the second cantilever spring arm 94 such that they move substantially in unison. Disposed in general vertical alignment with the mounting block 88 is a cylinder block 98 which may be integrally formed with or secured to the first end plate 16. The cylinder block 98 defines a first cylinder 102 and a second cylinder 104. The first and second cylinders 102 and 104 are axially aligned and their axis of alignment is preferably perpendicular to the surfaces 90 to which the first and second cantilever spring arms 92 and 94 are secured. A first passageway 106 extends through the cylinder block 98, the first end plate 16 and the housing 12 and provides communication between the first cylinder 102 and the first service port 42. A second passageway 108 extends through the cylinder block 98, the first end plate 16 and the housing 12 and provides communication between the second cylinder 104 and the second service port 44. A first piston 112 is axially slidably received within the first cylinder 102 and secured by suitable attachment means to the end of the first cantilever spring arm 92 opposite the mounting block 88. A second piston 114 is axially slidably received within the second cylinder 104 and is secured to the end of the second cantilever spring arm 94 opposite the mounting block 88 by suitable attachment means. If desired, the pistons 112 and 114 may include O-ring seals (not illustrated) about their peripheries.

The control rod 82 includes a radially extending torque arm 118. The torque arm 118 is integrally formed with or secured to the control rod 82 to coincide with the reference plane defined by the longitudinal center lines of the cantilever spring arms 92 and 94. Extending between the end of the torque arm 118 and the first cantilever spring arm 92 is a first spring 122. The first spring 122 is preferably a coil spring which is placed in tension when it is positioned between the torque arm 118 and the first cantilever spring arm 92. A second spring 124 which is identical to the first spring 122 is secured between the opposite side of the torque arm 118 and the second cantilever spring arm 94. So positioned, the second spring 124 is also placed in tension and the forces of the two coil springs 122 and 124 balance one another.

It will be appreciated that the precise sizes of the just described elements such as the length and thickness of the first and second cantilever spring arms 92 and 94, the size of the pistons 112 and 114, the spring rates of the springs 122 and 124 and radial length of the torque arm 118 are all matters of design choice which effect the amplification, that is, the transfer function of the servo valve assembly 10 and thus will vary and may be adjusted to conform to specific application parameters, as desired.

The operation of the servo valve assembly 10 will now be described with reference to FIGS. 1, 2, 3 and especially 4. As a beginning point, the servo valve assembly 10 is in a null position as illustrated in FIG. 3 with the second land 60 closing off the service port 42 and the third land 64 closing off the second service port 44.

The servo valve assembly 10 will respond to and seek a new operating position when an electrical signal is provided to the torque motor 86 which causes it to rotate the control rod 82. For purposes of example, it will be assumed that the input to the torque motor 86 results in clockwise motion of the control rod 82. Thus, the control rod 84 rotates to provide communication between the inlet port 34 and the chamber 78 through the first radial bore 66 and the flat 84 on the control rod 82. Pressure within the second chamber 78 thus increases and the piston 74 and valve spool 50 translate to the left as viewed in FIG. 3. Such translation of the valve spool 50 provides communication between the inlet port 34 and the first service port 42 thus increasing the pressure in the first service port 42 as well as in the first passageway 106. Simultaneously, communication is established between the second service port 44 and the second pressure return port 38.

Figure 2:
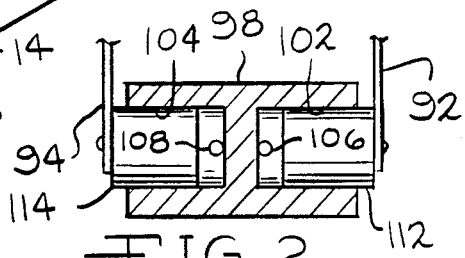
FIG. 2 is a sectional view of a portion of the feedback mechanism of the preferred embodiment of a servo valve with torque feedback according to the present invention taken along line 2—2 of FIG. 1.
Figure 3:
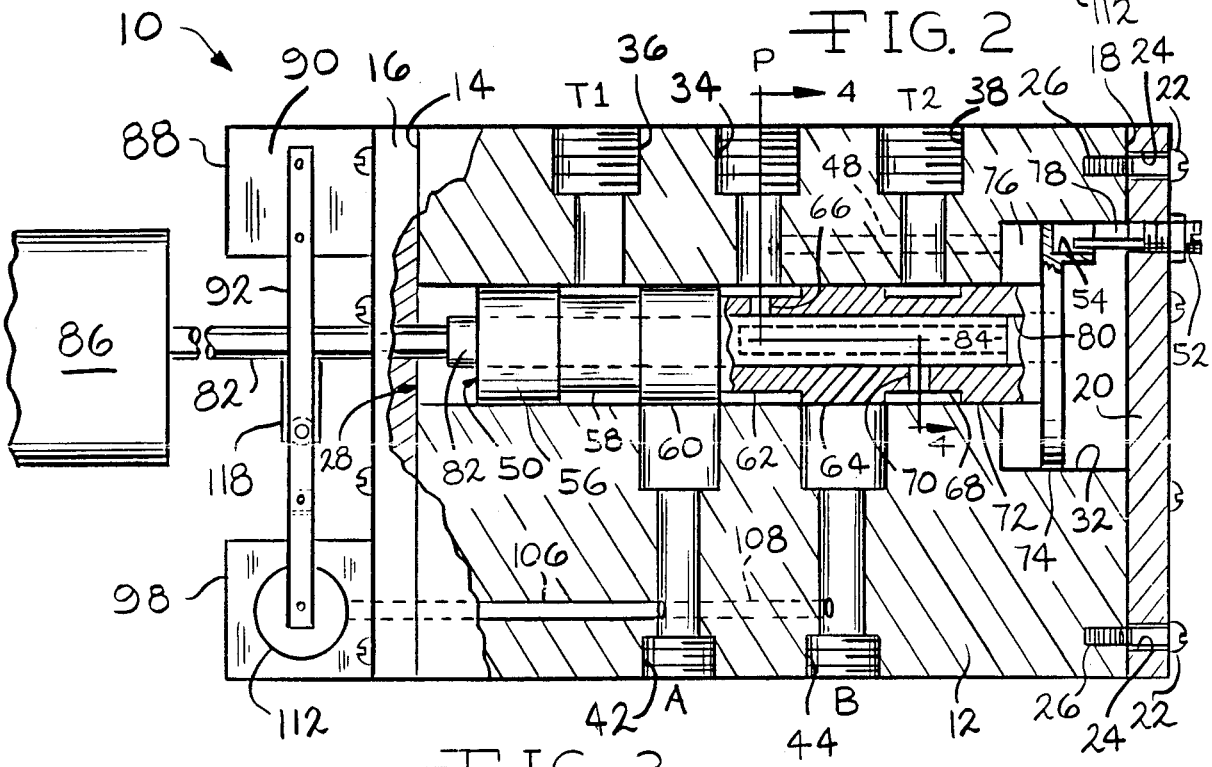
FIG. 3 is a side elevational view with portions broken away of the preferred embodiment of a servo valve with torque feedback according to the present invention.
Figure 4:
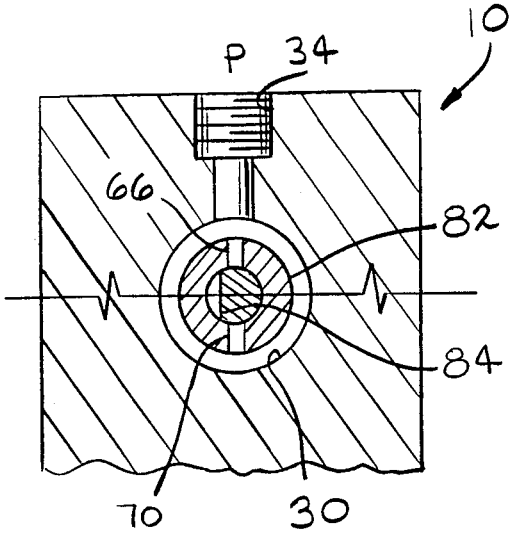
FIG. 4 is a fragmentary, sectional view of the preferred embodiment of a servo valve with torque feedback taken along line 4—4 of FIG. 3.

Pressure increase in the passageway 106 increases the fluid pressure within the cylinder 102 causing the piston 112 to translate to the right as viewed in FIG. 2, thereby providing a counterclockwise torque to the control rod 82 through the torque arm 118, first spring 122 and first cantilever spring arm 92. This action is assisted by the reduction of fluid pressure in the second service port 44, the second passageway 108 and the second cylinder 104, and corresponding leftward motion at the second piston 114. The counterclockwise torque rotates the control rod 82 back to its neutral or null position so that the valve spool 50 ceases translation. In this manner, the torque applied to the control rod 82 results in displacement of the valve spool 50 proportional to the input torque provided by the torque motor 86. Rotation of the torque motor 86 and the control rod 82 in the opposite, that is, counterclockwise direction provides communication from the second chamber 78, along the flat 84, through the second radial bore 70 and out the second return port 38. The reduction in the fluid pressure within the second chamber 78 causes the valve spool 50 to translate to the right as viewed in FIG. 3. Such translation initiates fluid communication between the inlet port 34 and the second service port 44 and a pressure increase therein. Simultaneously, communication is established between the first service port 42 and the first pressure return port 36. The pressure increase in the second service port 44 is communicated through the second passageway 108 to the cylinder 104 and causes axial translation of the position 114 to the left as viewed in FIG. 2. Such translation is transferred to the torque arm 118 through the second spring 124 and second cantilever spring arm 94 thereby applying a torque to the control rod 82 in a clockwise direction. This action is assisted by the reduction of fluid pressure in the first service port 42, the first passageway 106 and the first cylinder 102 and corresponding rightward motion of the first piston 112. This counter torque returns the control rod 82 to a null position and the valve spool 50 attains a displacement proportional to the input provided by the torque motor 86.

DESCRIPTION OF THE FIRST ALTERNATE EMBODIMENT

Figure 6:
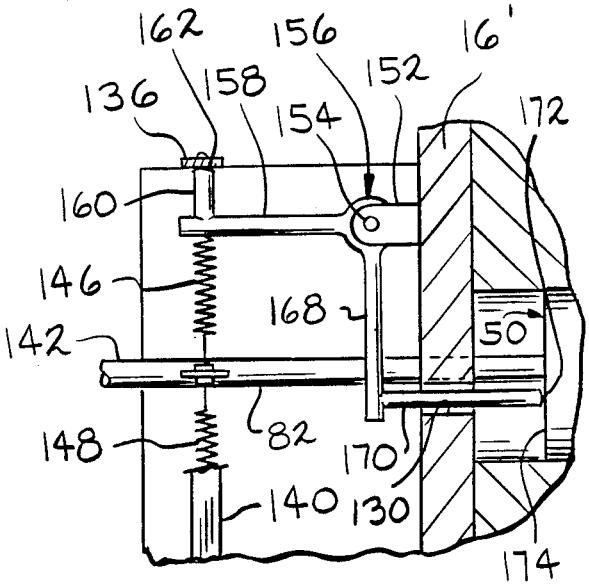
FIG. 6 is a fragmentary, sectional, side elevational view of the first alternate embodiment of a servo valve with torque feedback according to the present invention.
Figure 5:
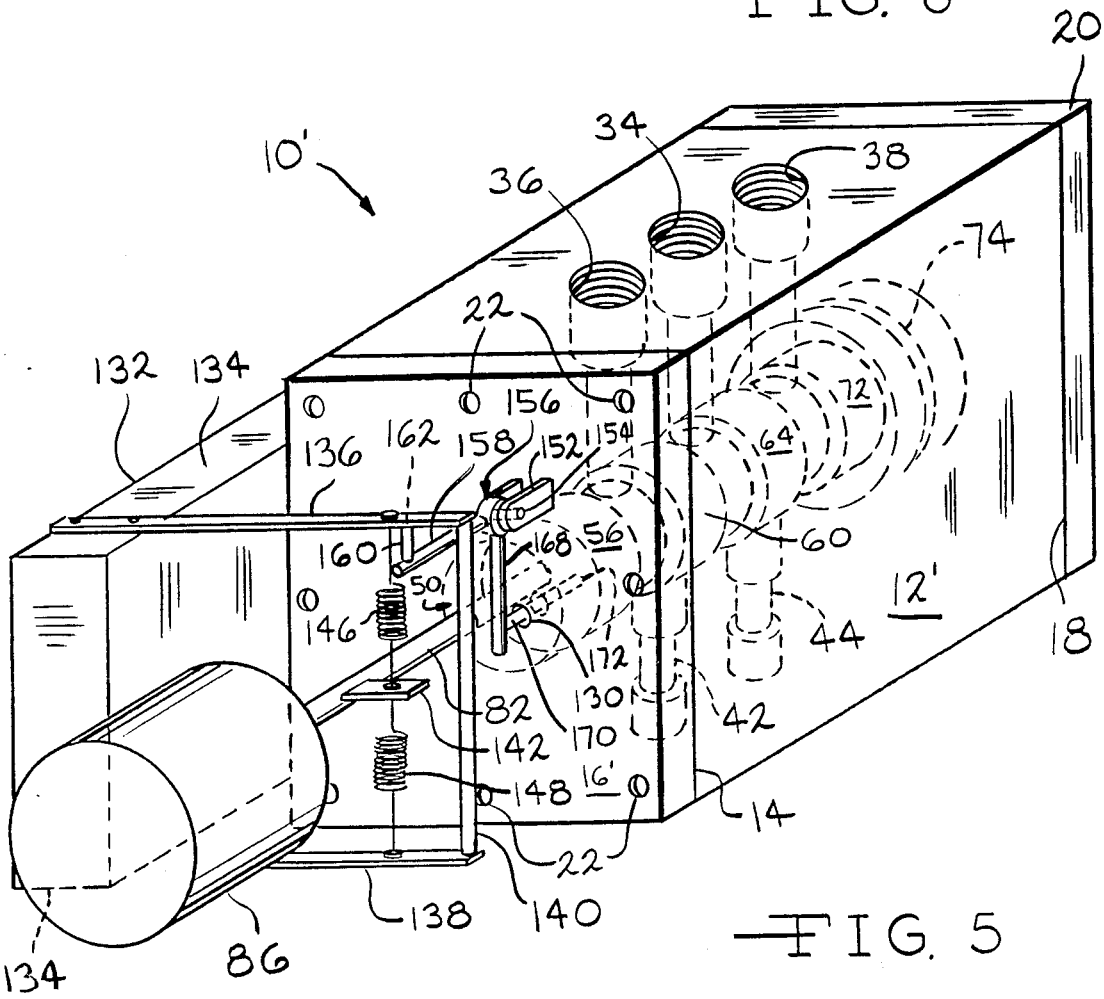
FIG. 5 is a perspective view of a first alternate embodiment of a servo valve with torque feedback according to the present invention.

Referring now to FIGS. 5 and 6, a first alternate embodiment servo valve assembly with torque feedback according to the present invention is illustrated and designated by the reference numeral 10'. With regard to the majority of components, the servo valve assembly 10' is identical to the preferred embodiment servo valve assembly 10. Specifically, it includes the second end plate 20, the bore 28 defining a longer, reduced diameter region 30 and a shorter, larger diameter cylinder 32. It likewise includes the pressure inlet port 34, the first pressure return port 36, the second pressure return port 38, the first service port 42, the second service port 44 and the inlet passageway 48. Disposed within the bore 28 is an identical valve spool 50 having the first land 56, the second land 60, the third land 64, the fourth land 72 interleaved with the first reduced diameter region 58, the second reduced diameter region 62 and the third reduced diameter region 68 as well as the piston 74. Likewise, the valve spool 50 defines the through axial bore 80 within which is slidably and rotatably received the control rod 82 having the chordal surface or flat 84. The control rod 82 is coupled to a control motor such as the torque motor 86.

The housing 12' is distinct in that it does not define or include either the first passageway 106 or the second passageway 108. Similarly, the first end plate 16' is distinct in that it likewise does not include portions of the first passageway 106 and the second passageway 108 but does include an aperture 130 generally adjacent the aperture through which the control rod 82 passes.

Formed as an integral portion of either the first end plate 16' or the housing 12' or secured to either or both the end plate 16' and the housing 12' is a mounting plate 132. The mounting plate 132 extends beyond the exposed face of the first end plate 16' and defines a pair of upper and lower parallel surfaces 134. To one of the parallel surfaces 134 is secured a first cantilever spring arm 136 and to the other of the parallel surfaces 134 is secured in a similar fashion a second parallel cantilever spring arm 138. A rigid link 140 couples the ends of the first cantilever spring arm 136 and the second cantilever spring arm 138 opposite the mounting plate 132 such that they move substantially in unison.

Secured to and extending radially from the control rod 82 is a lever or torque arm 142. The torque arm 142 is integrally formed with or secured to the control rod 82 to coincide with the reference plane defined by the longitudinal center lines of the cantilever spring arms 136 and 138. A first spring 146 is coupled to and extends between the first cantilever spring arm 136 and the torque arm 142. The first spring 146 is preferably a coil spring which is placed in tension when so disposed. A second spring 148 which identical to the first spring 146 is coupled to and extends between the second cantilever spring arm 138 and the torque arm 142. Again, the second spring 148 is preferably a coil spring which is placed in tension when so disposed. The forces of the two springs 146 and 148 balance one another.

Secured to and extending from the first end plate 16' is a clevis 152 which receives and supports a pivot pin 154. The pivot pin 154 is oriented along an axis generally parallel to the axes defined by the first and second cantilever spring arms 136 and 138, respectively. Pivotally mounted upon the pivot pin 154 is a right angle crank arm assembly 156. The right angle crank arm assembly 156 includes a first arm 158 which is oriented generally parallel to the axis of the valve spool 50 and normal to the reference plane defined by the longitudinal center lines of the first and second cantilever spring arms 136 and 138. The first arm 158 includes a first stub 160 having a arcuate terminal surface 162 which engages inside face of the first cantilever spring arm 136. The first stub 160 is oriented substantially parallel to the axes defined by the rigid link 140 and the springs 146 and 148. Oriented at a right angle to the first arm 158 is a second arm 168. The second arm 168 likewise includes a second stub 170 having an arcuate terminal surface 172. The second stub 170 is preferably oriented parallel to the axis of the control rod 82 and thus normal to the plane defined by the end surface 174 of the valve spool 50. The lengths of the various arms and stubs are preferably selected such that the crank arm assembly 156 has a unity motion transfer ratio about the pivot pin 154.

The operation of the alternate embodiment servo valve assembly 10' is similar to that of the preferred embodiment servo valve assembly 10 with the exception of the mechanism and manner through which feedback is achieved. Once again, the similarities between the preferred and alternate embodiment servo valve assemblies 10 and 10', respectively, should be appreciated and thus, with few exceptions which have been discussed above, reference to the features illustrated in FIGS. 3 and 4 will assist the understanding of the operation of the alternate embodiment servo valve assembly 10' illustrated in FIGS. 5 and 6.

Again, the operation of the servo valve assembly 10' will be described with the valve spool 50 and thus the overall assembly 10' initially in a null position. An electrical signal provided to the torque motor 86 will rotate the control rod 82 in proportion to the magnitude of the signal. For purposes of example, it will be assumed that the control rod 82 rotates in a clockwise direction, thus providing fluid communication between the inlet port 34 and the second chamber 78 through the first radial bore 66 and the flat 84 of the control rod 82. The pressure increase in the second chamber 78 resulting from such action will cause the valve spool 50 to translate axially to the left as viewed in FIGS. 5 and 6. Such translation establishes fluid communication between the inlet port 34 and the first service port 42 while also establishing fluid communication between the second service port 44 and the second pressure return port 38. Such translation also causes commensurate translation of the second stub 170 of the crank assembly 156 and rotation of the crank assembly 156 about the pivot pin 154 in a clockwise direction.

Since the second stub 170 and its line of action and the position of the first stub 160 and its line of action are equidistant from the pivot pin 154, motion from the valve spool 50 is transferred to the first cantilever spring arm 136 in the ratio 1:1 (unity). Leftward motion of the valve spool thus causes upward motion of the first cantilever spring arm 136 and this motion is transferred to the torque arm 142 through the first spring 146. Such motion applies a counterrotating torque to the control rod 82 that is, a torque in the counterclockwise direction thereby returning the control rod 82 to its initial null position. Thus the valve spool 50 is displaced in proportion to the input signal and rotation of the torque motor and the servo valve assembly 10' maintains a corresponding output pressure differential between the service ports 42 and 44.

An input signal to the torque motor 86 which causes it to rotate the control rod 82 in the counterclockwise direction provides the reverse operation of the servo valve assembly 10'. That is, the second chamber 78 is placed in fluid communication with the second pressure outlet port 38 through the second radial bore 70 and the control rod flat 84. Fluid pressure in the second chamber 78 thus reduces and the valve spool 50 translates to the right as viewed in FIGS. 5 and 6. Such translation establishes fluid communication between the inlet port 34 and the second service port 44 while also establishing fluid communication between the first service port 42 and the first pressure return port 36. Rightward translation of the valve spool 50 causes the crank arm assembly 156 to rotate in a counterclockwise direction about the pivot pin 154. The first cantilever spring arm 136 then descends reducing the tension on the torque arm 142 provided by the first spring 146 and increasing the torque on the torque arm 142 provided by the second spring 148. Thus, a clockwise torque which is opposite to the direction of the counterclockwise input provided by the servo motor 86 returns the control rod 82 to its initial, null position and the valve spool 50 once again is displaced proportionally to the input signal and maintains a corresponding output pressure differential between the service ports 42 and 44.

The mechanical linkage of the first alternate embodiment servo valve assembly 10' described above provides servo control through the cooperation of four basic elements: an input device (the control rod 82 and the torque motor 86), an output device (the valve spool 50), a feedback device (the crank arm assembly 156) and a difference accepting and null restoring device (the springs 136, 138, 146 and 148). Thus, it should be understood that various mechanical rearrangements of these elements such as coupling the crank arm assembly 156 to the rigid link 140 or placing the springs 146 and 148 on the opposite side of the control rod 82 from the rigid link 140 as well as substituting analogous structures which transfer axial motion of the valve spool 50 to motion tangential to the control rod 82 in place of the crank arm assembly 156, are considered to be within the purview of this invention.

The foregoing disclosure is the best mode devised by the inventor for practicing this invention. It is apparent, however, that devices incorporating modifications and variations will be obvious to one skilled in the art of servo controlled valves. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A servo valve comprising, in combination, a housing defining a bore and a plurality of ports axially spaced along and communicating with said bore, a valve spool slidably disposed within said bore, said valve spool having a plurality of alternating lands and reduced diameter regions, a piston defining a first chamber and a second chamber, an axial bore, a first radial passageway communicating between one of said reduced diameter regions and said axial bore and a second radial passageway communicating between another of said reduced diameter regions and said axial bore, a control rod disposed within said axial bore, said control rod defining an axial passageway and including a radially extending torque arm, a pair of cantilever spring arms, means for coupling each of said cantilever spring arms to said torque arm, and means for translating said cantilever spring arms, whereby rotation of said control rod in one direction places said first radial passageway in communication with said second chamber and rotation of said control rod in the opposite direction places said second radial passageway in communication with said second chamber.

2. The servo valve of claim 1 wherein said plurality of ports includes a pressure inlet port, two pressure return ports and two service ports.

3. The servo valve of claim 2 which said translating means includes a pair of pistons in cylinders in fluid communication with said service parts.

4. The rotary servo valve of claim 1 wherein said housing defines a passageway communicating between said pressure inlet port and said first chamber.

5. The servo valve of claim 1 further including means for selectively adjusting and fixing the angular position of said valve spool.

6. The servo valve of claim 4 wherein said means for selectively adjusting and fixing includes a member engaging said valve spool and means for translating said member about the axis of said valve spool.

7. The servo valve of claim 1 wherein said translating means includes means for coupling said valve spool to one of said cantilever spring arms.

8. The servo valve of claim 1 wherein said translating means includes a pivoted crank arm coupling said valve spool to one of said cantilever spring arms.

9. In a servo valve having a housing defining a plurality of ports communicating with a bore and a valve spool having alternate lands and reduced diameter regions slidably disposed within said bore, the improvement comprising:

a piston coupled to said valve spool, disposed within a cylinder and defining a first chamber in fluid communication with one of said plurality of ports and a second chamber, an axial bore extending through said valve spool, a first radial bore communicating between said axial bore and one of said reduced diameter regions, a second radial bore communicating between said axial bore and another of said reduced diameter regions, a control rod disposed in said axial bore defining a passageway communicating between said radial bores and said second chamber, first spring biased means for sensing the pressure in a first one of said ports, second spring biased means for sensing the pressure in a second one of said ports, and means for coupling said first spring biased means and said second spring biased means to said control rod and for converting bi-directional translation of said first spring biased means and said second spring biased means into bi-directional rotation of said control rod.

10. The improvement of claim 9 further including a rotational drive means coupled to said control rod for rotating said control rod in response to a control input.

11. The improvement of claim 9 wherein said ports include a fluid inlet port, a pair of fluid return ports and a pair of service ports and said one of said plurality of ports is said inlet port.

12. A servo valve comprising, in combination, a housing defining a bore and an inlet port, a pair of return ports and a pair of service ports axially spaced along and communicating with said bore, a valve spool slidably disposed within said bore, said valve spool having a plurality of alternating lands and reduced diameter regions, a first piston secured to said valve spool and defining a first chamber in fluid communication with said inlet port and a second chamber, an axial bore, a first radial passageway communicating between one of said reduced diameter regions and said axial bore and a second radial passageway communicating between another of said reduced diameter regions and said axial bore, a control rod disposed within said axial bore, said control rod including a flat defining an axial passageway in fluid communication with said second chamber and a radially extending arm, a pair of cantilever spring arms each secured at one end to said housing, a rigid link interconnecting the other end of each of said cantilever spring arms, spring means coupling each of said cantilever spring arms to said radially extending arm, and a pair of piston means coupled to a respective one of said pair of cantilever spring arms for sensing the output pressure of said servo valve.

13. The servo valve of claim 12 wherein said spring means are tension coil springs.

14. The servo valve of claim 12 further including a rotational drive means coupled to said control rod for providing a mechanical input signal to said servo valve.

15. The servo valve of claim 12 further including means for adjusting the angular position of said valve spool.

16. A servo valve comprising, in combination, a housing defining a bore and an inlet port, a pair of return ports and a pair of service ports axially spaced along and communicating with said bore, a valve spool slidably disposed within said bore, said valve spool having a plurality of alternating lands and reduced diameter regions, a first piston secured to said valve spool and defining a first chamber in fluid communication with said inlet port and a second chamber, an axial bore, a first radial passageway communicating between one of said reduced diameter regions and said axial bore and a second radial passageway communicating between another of said reduced diameter regions and said axial bore, a control rod disposed within said axial bore, said control rod including a flat defining an axial passageway in fluid communication with said second chamber and a radially extending arm, a spring mechanism including a pair of spring arms disposed on opposite sides of said control rod and a rigid member interconnecting one end of each of said spring arms, first means coupling said spring arms to said radially extending arm, and second means operatively coupling said valve spool and said spring mechanism.

17. The servo valve of claim 16 wherein said first coupling means are tension coil springs.

18. The servo valve of claim 16 further including a rotational drive means coupled to said control rod for providing a mechanical input signal to said servo valve.

19. The servo valve of claim 16 further including means for adjusting the angular position of said valve spool.

20. The servo valve of claim 16 wherein said second coupling means includes a crank having a first arm operatively coupled to said valve spool and a second arm disposed at a right angle to said first arm and operatively coupled to said spring mechanism.

21. The servo valve of claim 20 wherein said operative lengths of said first arm and said second arm are equal.

* * * * *